United States Patent [19]

Blanc et al.

[11] Patent Number: 4,474,611

[45] Date of Patent: Oct. 2, 1984

[54] ARRANGEMENT OF BUSBARS FOR ELECTROLYTIC REDUCTION CELLS

[75] Inventors: Jean-Marc Blanc, Sierre; Otto Knaisch, Uerikon; Hans Pfister, Dübendorf, all of Switzerland

[73] Assignee: Swiss Aluminium Ltd., Chippis, Switzerland

[21] Appl. No.: 503,034

[22] Filed: Jun. 10, 1983

[30] Foreign Application Priority Data

Jun. 23, 1982 [CH] Switzerland ..... 3838/82

[51] Int. Cl.[3] ..... C25C 3/16

[52] U.S. Cl. ..... 204/243 M; 204/244

[58] Field of Search ..... 204/67, 243 R, 243 M, 204/244

[56] References Cited

U.S. PATENT DOCUMENTS

| | | | |
|---|---|---|---|
| 3,969,213 | 7/1976 | Yamamoto et al. | 204/243 M X |
| 4,049,528 | 9/1977 | Morel et al. | 204/243 M |
| 4,313,811 | 2/1982 | Blanc | 204/244 |

*Primary Examiner*—Donald R. Valentine

*Attorney, Agent, or Firm*—Bachman and LaPointe

[57] ABSTRACT

An asymmetric arrangement of busbars for conducting direct electric current is conducted from the cathode bar ends of a transversely disposed aluminum fused salt reduction cell to the anode beam of the next cell wherein a fraction of the busbars connected to the cathode bar ends on the upstream side of the cell are led under the cell such that the busbar configuration in the cathodic part of the cell is such that the variation in the asymmetry of the current leading the cell from the upstream cathode bar ends lies between 3 and 30%.

13 Claims, 2 Drawing Figures

ARRANGEMENT OF BUSBARS FOR ELECTROLYTIC REDUCTION CELLS

BACKGROUND OF THE INVENTION

The present invention relates to an asymmetric arrangement of busbars for conducting the direct electric current from the cathode bar ends of a transversely disposed aluminum fused salt reduction cell to the anode beam of the next cell wherein a number of the busbars connected to the upstream cathode bar ends runs under the cell.

The production of aluminum via the fused salt electrolytic reduction of aluminum oxide involves dissolving the latter in a fluoride melt, the greater part of which is comprised cryolite. The precipitated aluminum collects under the fluoride melt on the carbon floor of the cell, the surface of the liquid aluminum itself forming the actual cathode in the process. Dipping into the melt from above are anodes which in the conventional processes are made of amorphous carbon. Oxygen is produced at the carbon anodes as a result of the electrolytic decomposition of the aluminum oxide; this oxygen combines with the carbon in the anodes to form $CO_2$ and CO.

The electrolytic process takes place in a temperature range of approximately 940°-970° C. During the process the electrolyte becomes depleted in aluminum oxide. At a lower concentration of 1-2 wt.% aluminum oxide the anode effect occurs whereby the voltage rises from 4-5 V to 30 V and more. At this time at the latest the concentration of aluminum oxide must be raised by the addition of more alumina.

Embedded in the floor of the cell are cathode bars the ends of which protrude out of both sidewalls of the cell which are made up of a steel shell, insulation and carbon lining.

Energy losses of the order of up to 1 kWh/kg of aluminum produced are experienced as a result of the ohmic resistance in the stretch between the cathode bars and the anodes of the next cell. As a result, many attempts have been made to optimize the arrangement of the busbars with respect to ohmic resistance. In doing so, however, one must take into account the vertical components of the induced magnetic field which, together with the horizontal components of current density, produce field forces in the metal produced in the reduction process.

In an aluminum smelter with a series of transversely arranged reduction cells the current flows from cell to cell as follows: the direct electric current is collected by the cathode collector bars embedded in the carbon floor of the cell and leaves the cells, with respect to the general direction of current flow, at the upstream and downstream ends of these collector bars. The iron cathode bars are connected to aluminum busbars via flexible strips. The busbars, generally brought together as collector bars lead the direct current to the vicinity of the next cell where the current is conducted via other flexible strips and risers to the beam supporting the suspended anodes. Depending on the type of cell the risers are electrically connected to the end and/or one long side of the anode beam.

These busbars, characteristic for aluminum smelters, produce however disturbing effects both of an electrical and magnetic nature; attempts to eliminate these effects have been the subject of many publications up to now.

Disclosed in the British Pat. No. 1,032,810 in connection with an invention which is concerned with the hooding of cells is the proposal that the busbars can be arranged under the reduction cell. According to FIG. 2 of the British patent conductors 135 run, with respect to the transverse direction of the cell, symmetrically under the cell and are connected symmetrically to the anode beam of the next cell.

U.S. Pat. No. 3,415,724 aims at a conductor arrangement by which the magnetic effects are not increased when the current level is increased. To this end a part of the current leaving upstream from the cathode bar ends, but less than half, is conducted under the cell. The rest of the current leaving the cathode bar ends is led around the ends of the cell in a concentrated manner. As shown in FIG. 3 of the '724 patent the conductors leading the current under the cell lie at the middle of the cell and are in the form of collector conductor bars. The feeding of the current to the anode beam of the next cell is made at four points on the long side of the anode beam, symmetrical with respect to the transverse axis of the cell.

The disclosure of U.S. Pat. No. 4,313,811 is also drawn to an arrangement of conductor bars to conduct the direct electric current from the cathode bar ends of one transverse reduction cell to the anode beam of the next cell. The busbars connected to the upstream cathode bar ends are led alternately singly under the cell and in groups around the cell. The alternating groups comprise 1-5 conductor bars; preferably about a quarter of the total current is led under the cell.

Although, and in particular by means of the method in the last mentioned publication, the undesired magnetic and electrical effects can be largely eliminated, it is the object of the present invention to develop an arrangement of busbars for transverse fused salt aluminum reduction cells by means of which the investment costs and the current yield are optimized under conditions of practically negligible magnetic and electrical effects.

SUMMARY OF THE INVENTION

The foregoing object is achieved by way of the invention wherein the busbar configuration in the cathodic part of the cell comprises a group of busbars which are connected to 10-40% of the upstream cathode bar ends and are led singly under the cell. The busbars which are connected to the rest of the upstream cathode bar ends are led collectively on both sides of that group of busbars around the ends of the cell, and busbars which connect up to 2-6 risers and conduct the whole of the electric current from the upstream and downstream ends of the cathode bars, the variation in asymmetry of the current from the upstream cathode bar ends lying between 3 and 30%.

By asymmetry is meant the difference in the currents which flow around both ends of the cell, expressed as a percentage of the total current flowing from the upstream cathode bar ends.

The group of busbars in the central part of the cell and running individually under the cell is preferably connected to 15-30% of the upstream cathode bar ends.

According to a first embodiment of the invention the group of busbars at the central part of the cell and running individually under the cell are displaced, with respect to the transverse axis of the cell, 3-30%, preferably 3-20%, and this in the direction away from the neighboring row of cells which lead the current back up the potroom. Each of the busbars connected to the rest of the upstream cathode bar ends run around the end of the cell nearer the cathode bar ends in question, if they run along the long side of the cell past the busbars which run under the cell. In other words, the whole of that part of the current which leaves the upstream cathode bar ends and does not flow under the cell is never conducted around the same end of the cell. This means that more current is conducted around the cell at the end lying nearer to the neighboring row of cells. As a result of the asymmetry the undesireable magnetic effects from the neighboring row of cells are compensated.

According to a further embodiment of the invention the group of busbars at the central part of the cell and passing individually under the cell are arranged symmetrically with respect to the transverse axis of the cell. The asymmetry is achieved by connecting up 3–35%, preferably 3–20% of the upstream cathode bar ends immediately adjacent to the group of busbars which pass under the cell and away from the neighboring row of cells to at least one busbar which runs/run around the "wrong" end of the cell. The term "wrong" is used here to indicate that this busbar/these busbars running in the longitudinal direction of the cell runs/run past the busbars which are led under the cell and thus produces/produce the asymmetry. All the other busbars connected to the rest of the upstream cathode bar ends run as normal around the nearer end of the cell without running along the long side of the cell past the group of busbars which run under the cell.

The two above versions can be combined. The group of busbars situated at the center part of the cell and running under the cell can normally be displaced 3–30% or slightly less, for example 3–27%, preferably 3–17%, in the direction pointing away from the neighboring row of cells. Likewise, the number of upstream cathode bar ends immediately adjacent to the group of busbars at the center, on the side away from the neighboring row of cells and connected to at least one of the busbars running round the end of the cell facing the neighboring cells, can be left at the normal 3–35% or preferably reduced somewhat, for example to 3–20%.

The risers which collect the total electric current from the upstream and downstream cathode bar ends connect up preferably to the side of the anode beam of the next cell that is to its long side. The connection made by both outer risers is then displaced preferably at least 5% with respect to the length of the anode beam from the end towards the middle of the anode beam.

The risers, usefully 3–4, are led to the anode beam of the next cell preferably symmetrically with respect to the transverse axis of the cell.

BRIEF DESCRIPTION OF THE DRAWINGS

The invention is described in greater detail with the help of the following schematic drawings wherein.

DETAILED DESCRIPTION

Figure 1:
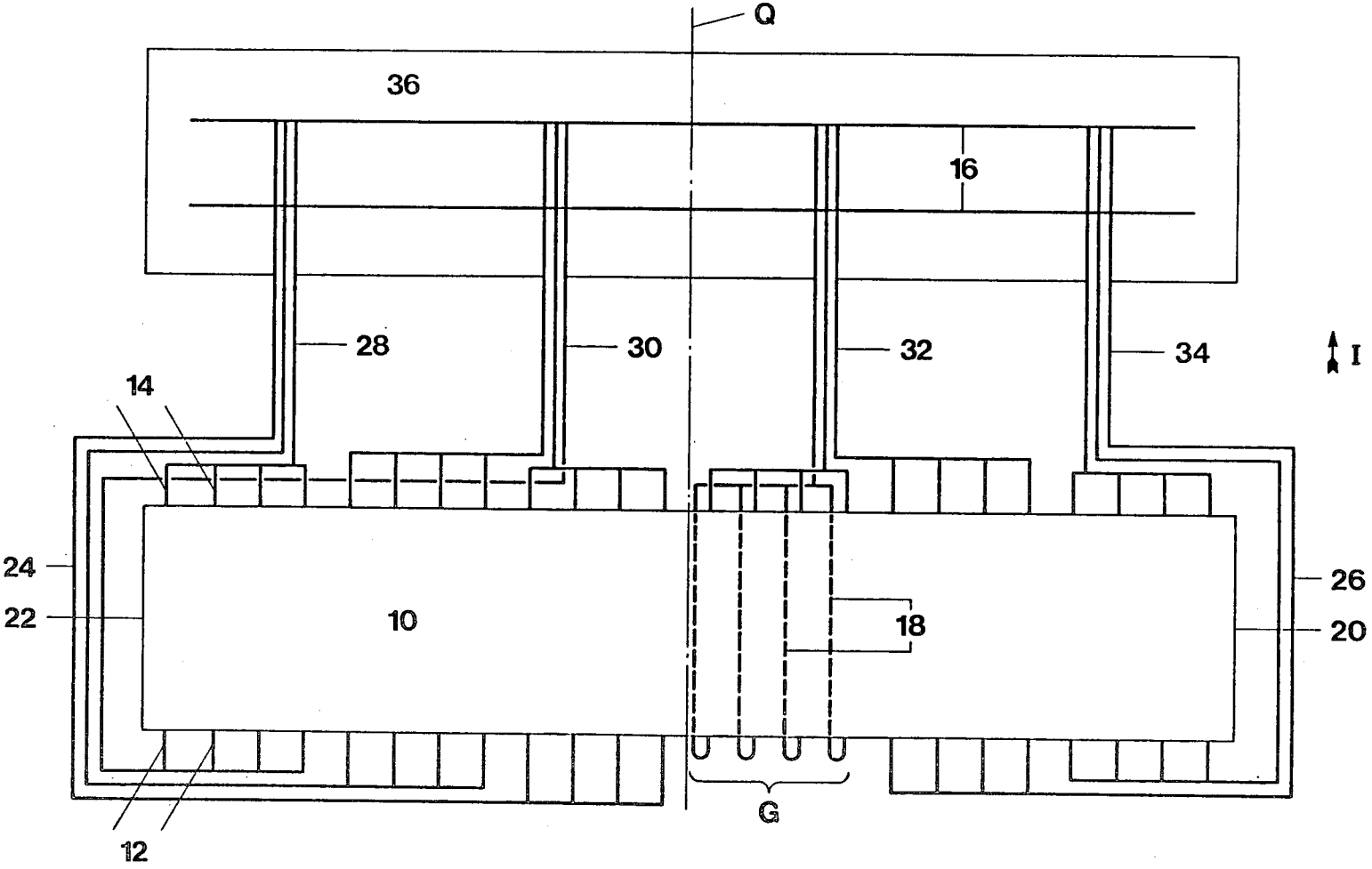
FIG. 1 is an asymmetric arrangement of busbars from an electrolytic cell to the anode beam of the next cell, having four asymmetrically arranged busbars running under the cell.

The electrolytic cell 10 in FIG. 1 features twenty-four cathode bars having, with respect to the general direction of current flow I, upstream ends 12 and downstream ends 14. These iron cathode bar ends 12 and 14 are connected to aluminum busbars which conduct the electric current to the anode beam 16 of the next cell.

In the central region of the cell 10 a group of four busbars 18 pass under the cell. These busbars 18 are, with respect to the transverse axis Q of the cell, that is the position of symmetry, displaced two cathode bar ends in the direction of the end 20 of the cell 10 away from the neighboring row of cells. In the present example, therefore, 16.7% of the current leaving the upstream cathode bar ends does so via the busbars 18 running under the cell 10.

The current from twelve cathode bar ends flows through the busbars 24 which are led around end 22 of the cell facing the neighboring row of cells. On the other hand the current from only eight cathode bar ends flows through the busbars 26 which run around the end 20 of the cell 10 away from the neighboring row of cells. This asymmetry of four is achieved by an 8.3% displacement of group G.

The busbars 24,26 join up with busbars from the downstream cathode bar ends 14 and lead symmetrically with respect to the transverse axis Q of the cell to the anode beam 16 of the next cell 36 as four risers 28,30,32,34. These connect up to the long side of the anode beam 16, the outer risers 28,34 being displaced about 10%, with respect to the whole length of the anode beam, from the ends of that beam.

Figure 2:
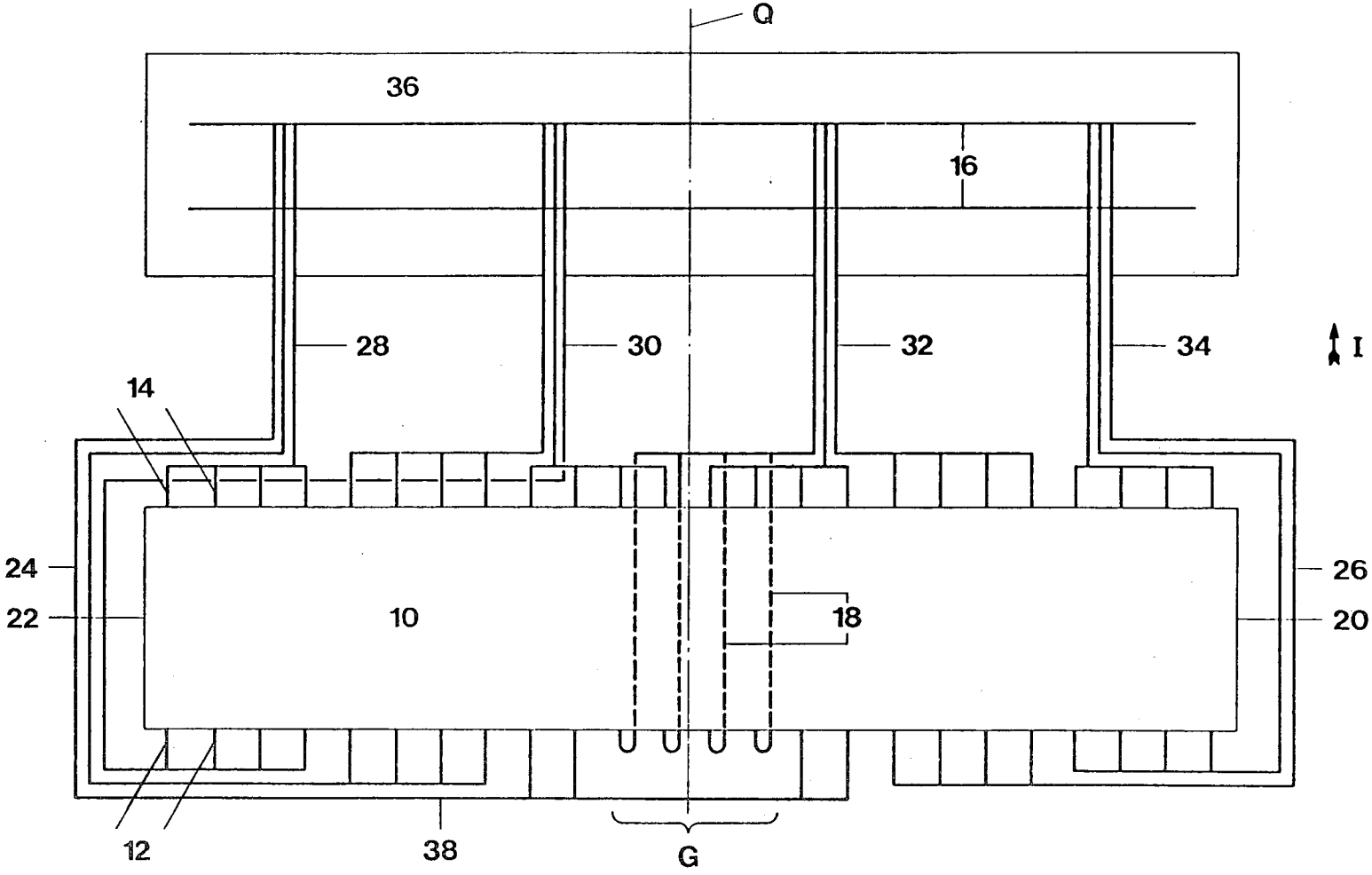
FIG. 2 is an arrangement of busbars from an electrolytic cell to the anode beam of the next cell having four symmetrically arranged busbars which run under the cell and a busbar which is connected to two cathode bar ends and runs around the "wrong" end of the cell.

In the arrangement of busbars according to FIG. 2 the group G of four busbars 18 running under the cell lie symmetrically with respect to the transverse axis Q of the cell. As in FIG. 1 they conduct 16.7% of the current from the upstream cathode bar ends 12 under the cell. The asymmetry is achieved by conducting the current from two upstream cathode bar ends 12 around the "wrong" end 22 of the cell 10 by means of a busbar 38 running in the longitudinal direction of the cell past the group G of busbars. These busbars 24 (which also contain the current of busbar 38) which run around the end 22 facing the neighboring row of cells conduct the current of twelve upstream cathode bar ends. The busbars 26 running around the end 20 away from the neighboring row of cells on the other hand conduct the current of only eight upstream cathode bar ends. The result is an asymmetry of four.

The risers 28,30,32,34, arranged as in FIG. 1, conduct the direct electric current in two branches to the anode beam 16 of the next cell 36.

In the case of the busbars 18 it is very important that these run singly under the cell at the spacing of the cathode bars. The busbars 24,26 on the other hand can be groups of individual conductor bars or a single conductor of the corresponding cross section.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An asymmetric arrangement of busbars for conducting the direct electric current from the cathode bar ends of a transverse fused salt reduction cell used for producing aluminum to the anode beam of the next cell, wherein a fraction of the busbars connected to the cathode bar ends on the upstream side of the cell are passed under the cell, the configuration of the busbars in the cathodic part of the cell comprises:

a first group of busbars connected in the middle part of the cell to 10–40% of the upstream cathode bar ends are passed singly under the cell; and a second group of busbars connected to the rest of the upstream cathode bar ends are led collectively on both sides of said first group of busbars around the ends of the cell, wherein said second group of busbars connect up to from 2–6 risers and conduct the whole of the electric current from the upstream and downstream ends of the cathode bars such that the variation in asymmetry of the current from the upstream cathode bar ends lies between 3 and 30% wherein said first group of busbars are displaced, with respect to the transverse axis of the cell, 3–30% in the direction away from the neighboring row of cells, and said second group of busbars are led around the end of the cell closest to the cathode bar ends in question.

2. An arrangement of busbars according to claim 1 wherein said first group of busbars are connected to 15–30% of the upstream cathode bar ends.

3. An arrangement of busbars according to claim 1 wherein said risers connect up to the side of the anode beam of the next cell and wherein the two outer risers are displaced at least 5% with respect to the length of the anode beam from the end towards the middle.

4. An asymmetric arrangement of busbars for conducting the direct electric current from the cathode bar ends of a transverse fused salt reduction cell used for producing aluminum to the anode beam of the next cell, wherein a fraction of the busbars connected to the cathode bar ends on the upstream side of the cell are passed under the cell, the configuration of the busbars in the cathodic part of the cell comprises:

a first group of busbars connected in the middle part of the cell to 10–40% of the upstream cathode bar ends are passed singly under the cell; and a second group of busbars connected to the rest of the upstream cathode bar ends are led collectively on both sides of said first group of busbars around the ends of the cell, wherein said second group of busbars connect up to from 2–6 risers and conduct the whole of the electric current from the upstream and downstream ends of the cathode bars such that the variation in asymmetry of the current from the upstream cathode bar ends lies between 3 and 30% wherein said first group of busbars are arranged symmetrically with respect to the transverse axis of the cell, wherein 3–35% of the upstream cathode bar ends which are situated immediately adjacent to said first group of busbars are connected on the side away from the neighboring row of cells to at least one busbar which runs around the end of the cell facing the neighboring row of cells, and wherein said second group of busbars connected to the rest of the upstream cathode bar ends run around the end of the cell closest to the cathode bar ends in question.

5. An arrangement of busbars according to claim 4 wherein said first group of busbars are connected to 15–30% of the upstream cathode bar ends.

6. An arrangement of busbars according to claim 4 wherein said first group of busbars is, asymmetrically, 3–20% displaced.

7. An arrangement of busbars according to claim 4 wherein 3–20% of the upstream cathode bar ends which are situated immediately adjacent to said first group of busbars are connected, on the side away from the neighboring row of cells, to busbars which run around the end of the cell facing the neighboring row of cells.

8. An arrangement of busbars according to claim 4 wherein said risers connect up to the side of the anode beam of the next cell and wherein the two outer risers are displaced at least 5% with respect to the length of the anode beam from the end towards the middle.

9. An asymmetric arrangement of busbars for conducting the direct electric current from the cathode bar ends of a transverse fused salt reduction cell used for producing aluminum to the anode beam of the next cell, wherein a fraction of the busbars connected to the cathode bar ends on the upstream side of the cell are passed under the cell, the configuration of the busbars in the cathodic part of the cell comprises:

a first group of busbars connected in the middle part of the cell to 10–40% of the upstream cathode bar ends are passed singly under the cell; and a second group of busbars connected to the rest of the upstream cathode bar ends are led collectively on both sides of said first group of busbars around the ends of the cell, wherein said second group of busbars connect up to from 2–6 risers and conduct the whole of the electric current from the upstream and downstream ends of the cathode bars such that the variation in asymmetry of the current from the upstream cathode bar ends lies between 3 and 30% wherein said first group of busbars are displaced, with respect to the transverse axis of the cell, 3–30% away from the neighboring row of cells and wherein 3–35% of the upstream cathode bar ends which are situated immediately adjacent to said first group of busbars are connected on the side away from the neighboring row of cells to at least one busbar which runs around that end of the cell facing the neighboring row of cells while the second group of busbars connected to the rest of the upstream cathode bar ends run around the end of the cell closest to the cathode bar ends in question.

10. An arrangement of busbars according to claim 9 wherein said first group of busbars are connected to 15–30% of the upstream cathode bar ends.

11. An arrangement of busbars according to claim 9 wherein said first group of busbars is, asymmetrically, 3–20% displaced.

12. An arrangement of busbars according to claim 9 wherein 3–20% of the upstream cathode bar ends which are situated immediately adjacent to said first group of busbars are connected, on the side away from the neighboring row of cells, to busbars which run around the end of the cell facing the neighboring row of cells.

13. An arrangement of busbars according to claim 9 wherein said risers connect up to the side of the anode beam of the next cell and wherein the two outer risers are displaced at least 5% with respect to the length of the anode beam from the end towards the middle.

* * * * *